US012442591B2

(12) United States Patent
Song et al.

(10) Patent No.: US 12,442,591 B2
(45) Date of Patent: Oct. 14, 2025

(54) VACUUM INSULATION PANEL, APPARATUS FOR MANUFACTURING VACUUM INSULATION PANEL, AND METHOD FOR MANUFACTURING VACUUM INSULATION PANEL

(71) Applicant: LG ELECTRONICS INC., Seoul (KR)

(72) Inventors: Seunghan Song, Seoul (KR); Byungjun Mun, Seoul (KR); Jinwoo Shim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/535,540

(22) Filed: Dec. 11, 2023

(65) Prior Publication Data

US 2024/0344758 A1 Oct. 17, 2024

(30) Foreign Application Priority Data

Apr. 17, 2023 (KR) ..... 10-2023-0050290

(51) Int. Cl.
*F25D 23/06* (2006.01)

(52) U.S. Cl.
CPC ..... *F25D 23/065* (2013.01); *F25D 2201/14* (2013.01); *F25D 2323/06* (2013.01)

(58) Field of Classification Search
None
See application file for complete search history.

(56) References Cited

U.S. PATENT DOCUMENTS

| | | | | |
|---|---|---|---|---|
| 10,858,279 | B2 | 12/2020 | Shimizu et al. | |
| 10,941,068 | B2 * | 3/2021 | Nonaka | E06B 3/6612 |
| 2012/0285199 | A1 | 11/2012 | Li et al. | |
| 2019/0203523 | A1 | 7/2019 | Park | |
| 2019/0247956 | A1 * | 8/2019 | Azuma | B23K 26/1476 |
| 2021/0388667 | A1 | 12/2021 | Sato | |

FOREIGN PATENT DOCUMENTS

| | | | |
|---|---|---|---|
| CN | 112839914 | A | 5/2021 |
| EP | 0 489 042 | B1 | 3/1996 |
| EP | 3 170 800 | B1 | 9/2019 |
| JP | 2002-12455 | A | 1/2002 |
| JP | 6739639 | B2 | 8/2020 |

(Continued)

OTHER PUBLICATIONS

Machine translation of KR 20150024730 (Year: 2025).*

*Primary Examiner* — Maria V Ewald
(74) *Attorney, Agent, or Firm* — Birch, Stewart, Kolasch & Birch, LLP

(57) ABSTRACT

A vacuum insulation panel includes a panel assembly having a first panel having a transparent material, a second panel joined to the first panel, the second panel having a transparent material, a vacuum layer formed between the first panel and the second panel; and an exhaust hole located in one of the first panel or the second panel, the exhaust hole being configured to exhaust internal gas to form the vacuum layer. The panel assembly also includes a sealing cap configured to seal the exhaust hole, the sealing cap being made of a magnetic material. A method and an apparatus for manufacturing the vacuum insulation panel is also provided.

13 Claims, 19 Drawing Sheets

(56) References Cited

FOREIGN PATENT DOCUMENTS

| | | | |
|---|---|---|---|
| KR | 10-2013-0022535 | A | 3/2013 |
| KR | 10-2015-0024730 | A | 3/2015 |
| KR | 10-1902062 | B1 | 9/2018 |
| KR | 10-2487391 | B1 | 1/2023 |
| WO | WO 2011//063701 | A1 | 6/2011 |

* cited by examiner

VACUUM INSULATION PANEL, APPARATUS FOR MANUFACTURING VACUUM INSULATION PANEL, AND METHOD FOR MANUFACTURING VACUUM INSULATION PANEL

CROSS-REFERENCE TO RELATED APPLICATION

The present application claims priority under 35 U.S.C. 119 to Korean Patent Application No. 10-2023-0050290, filed on Apr. 17, 2023, the disclosure of which is hereby incorporated by reference in its entirety.

BACKGROUND

The present disclosure relates to a vacuum insulation panel, an apparatus for manufacturing vacuum insulation panel, and a method for manufacturing vacuum insulation panel.

Vacuum insulation panels can be used on the doors of home appliances. For example, the vacuum insulation panel can be used on the door of a refrigerator or cooking appliance.

The vacuum insulation panel may include transparent glass. When glass is applied to the door of the home appliance, there is an advantage that food stored or put in the home appliance can be easily checked through the transparent glass without opening the door.

However, due to the own characteristics thereof, glass has a low insulation rate, which has the disadvantage of allowing cold air stored in the refrigerator to leak to the outside through the glass. In particular, when the glass is made of a single layer of plate glass, the problem of low insulation rate can become more serious.

To compensate for this low insulation rate, the glass may be composed of double-layer glass or vacuum glass composed of at least two panes of glass. The double-layer glass may be constructed by injecting a specific gas with a low heat transfer rate between the two panes of glass.

Meanwhile, vacuum glass can be constructed by forming a vacuum in the space between the two panes of glass. In terms of its ability to block heat transfer between the inside and outside of the glass, the vacuum glass may be advantageous over the double-layer glass.

The vacuum glass can be manufactured using an apparatus for manufacturing vacuum glass. For example, the apparatus for manufacturing vacuum glass may include a heating device that melts a sealing member for joining two glass plates, a vacuum device that vacuums the inside of the two glass plates, and a capping device that seals the exhaust hole that is formed in the glass plate.

According to conventional manufacturing apparatus, the following problems exist.

First, since the manufacturing process has to be carried out by preparing a high-temperature vacuum chamber that creates a vacuum atmosphere and putting the vacuum insulation panel into the vacuum chamber, the process of raising and lowering the temperature takes a long time, so there was a problem that the production time of vacuum insulation panels was prolonged.

Second, a process of capping the exhaust hole of the panel is performed using high-temperature radiant heat, but there is a problem in that the glass is damaged due to thermal shock due to the high-temperature heat acting on the glass panel.

SUMMARY

An object of the present disclosure is to provide a vacuum insulation panel that can shorten the process time by performing an exhaust process and a heating process in a vacuum chamber at a room temperature.

An object of the present disclosure performs induction heating of the sealing cap using a heating coil, thereby allowing local heating of the sealing material through the sealing cap without transferring high temperature heat to the glass, thereby providing a vacuum insulating panel that can prevent breakage of the glass.

An object of the present disclosure is to provide a vacuum insulation panel in which the sealing cap and the sealing material are joined by seating the sealing cap on the sealing material using a cylinder and heating the sealing material through the induction heating sealing cap.

An object of the present disclosure is to provide a vacuum insulation panel in which a sealing cap and a sealing material can be firmly coupled by pressing the sealing cap using a cylinder.

An object of the present disclosure is to provide a vacuum insulation panel where the sealing cap can be positioned in place at the joining position of the sealing material by providing a seating guide on the sealing cap.

The vacuum insulation panel according to an embodiment of the present disclosure may include a sealing cap configured to seal an exhaust hole of the panel assembly, and a heating coil configured to be inductively heating the sealing cap.

The sealing cap may be made of a metal material that can be inductively heated. For example, the sealing cap may be made of stainless steel.

The vacuum insulation panel includes a sealing material placed in the exhaust hole, and the sealing material may be melted by the inductively heated sealing cap. Accordingly, high temperature heat is not transmitted to the plate glass in the panel assembly, and local heating of the sealing material can be performed through the sealing cap.

The sealing material forms a through-hole aligned with the exhaust hole of the panel assembly, and the sealing cap may shield the through hole.

The sealing cap may be moved toward the sealing material by a cylinder and may be seated on the sealing material to shield the through hole.

The sealing cap includes a seating guide that guides the sealing material to be seated at a joining position, and the seating guide may protrude in a direction facing from the cap main body of the sealing cap to the sealing material.

The seating guide may protrude from the center of the sealing cap and be inserted into a through-hole of the sealing material.

The seating guide may protrude from an edge of the sealing cap and surround at least a portion of the outer peripheral surface of the sealing material.

The apparatus for manufacturing a vacuum insulation panel may include a cylinder to which the sealing cap is attached. The cylinder may be movably provided in the process chamber.

The cylinder may include an electromagnet so that the sealing cap can be detached.

With the sealing cap attached, the cylinder may be moved in a direction facing the panel assembly until the sealing cap is seated on the sealing material. When the sealing cap is seated on the sealing material, the cylinder is separated from the sealing cap and can move in a direction away from the panel assembly.

When the sealing cap is inductively heated and the sealing material is melted, the cylinder moves toward the sealing cap and presses the sealing cap so that the sealing cap is firmly joined to the sealing material.

A vacuum insulation panel according to an embodiment of the present disclosure includes a panel assembly including a first panel made of a transparent material, a second panel joined to the first panel and made of a transparent material and a vacuum layer formed between the first panel and the second panel; an exhaust hole that is formed in the first panel or the second panel and exhausts internal gas to form the vacuum layer; and a sealing cap configured to seal the exhaust hole, in which the sealing cap may be made of a magnetic material that is capable of being attached to a magnet.

The vacuum insulation panel further includes a sealing material provided between the sealing cap and the panel assembly to prevent the sealing cap from being in contact with the panel assembly, in which the sealing cap may be made of a metal material capable of induction heating by a heating coil.

The sealing material may have a ring shape to form a through-hole communicating with the exhaust hole, and the sealing cap may have a plate shape to shield the through-hole.

The sealing material may be made of glass or ceramic material so that when the sealing cap is inductively heated, the sealing material melts and attaches to the sealing cap.

The first and second panels may be made of glass or ceramic material so that the first and second panels are not directly heated by the heating coil when the sealing cap is inductively heated.

The sealing cap may include a seating surface seated on the sealing material, and the seating surface may have a heating surface that transfers heat to the sealing material during induction heating.

The sealing cap may include a plate-shaped cap main body and a seating guide part that protrudes from the cap main body and is inserted into a through-hole of the sealing material.

The seating guide part may protrude from the cap main body in a conical or cylindrical shape.

The seating guide part may protrude from an edge of the cap main body and may be disposed to surround a portion of the outer peripheral surface of the sealing material.

A protrusion may be formed on the inner surface of the exhaust hole to support the sealing cap so that the outer surface of the sealing cap is coplanar with respect to the outer surface of the panel assembly.

The sealing cap may be in direct contact with the outer surface of the panel where the exhaust hole is formed among the first and second panels.

A method for manufacturing a vacuum insulation panel according to an embodiment of the present disclosure includes a panel assembly including a first panel made of a transparent material, a second panel joined to the first panel and made of a transparent material and a vacuum layer formed between the first panel and the second panel; and an exhaust hole formed in the first panel or the second panel and exhausts internal gas to form the vacuum layer.

The method for manufacturing a vacuum insulation panel may include installing a sealing material in the exhaust hole; installing a chamber housing at a room temperature in the panel assembly and driving an exhaust pump to exhaust internal gas through the exhaust hole; installing a sealing cap on the sealing material; and heating the sealing material or the sealing cap.

The heating the sealing material or the sealing cap may include disposing a heating coil outside the panel assembly; and inductively heating the sealing cap by applying electric current to the heating coil.

The sealing material may be disposed between the sealing cap and the panel assembly to prevent the sealing cap from being in contact with the panel assembly, and the inductively heating the sealing cap may include melting the sealing material.

The method for manufacturing a vacuum insulation panel may further includes moving a cylinder to the sealing cap and pressing the sealing cap, after melting the sealing material.

The installing a sealing cap on the sealing material may include moving an electromagnet to which the sealing cap is attached to the sealing material; and seating the sealing cap on the sealing material.

The heating the sealing material or the sealing cap may include disposing a heating coil inside the chamber housing; and operating the heating coil to melt the sealing material.

An apparatus for manufacturing a vacuum insulation panel according to an embodiment of the present disclosure includes a panel assembly including a first panel made of a transparent material, a second panel joined to the first panel and made of a transparent material and a vacuum layer formed between the first panel and the second panel; an exhaust hole formed in a first panel or a second panel and exhausting internal gas to form the vacuum layer; a sealing cap configured to seal the exhaust hole; and a sealing material provided between the sealing cap and the panel assembly to prevent the sealing cap from being in contact with the panel assembly.

The apparatus for manufacturing a vacuum insulation panel may include a chamber housing installed on the panel assembly and having an internal space communicating with the exhaust hole; a cylinder movably provided in the chamber housing and to which the sealing cap is attached, the cylinder being configured to seat the sealing cap on the sealing material; and a heating coil configured to heat the sealing cap.

The cylinder may include an electromagnet so that the sealing cap is selectively attached to the cylinder.

The heating coil may include an induction heating coil installed outside the chamber housing, or a coil installed inside the chamber housing to melt a sealing material for attaching the sealing cap to the panel assembly.

According to an embodiment of the present disclosure, the process time for a vacuum insulation panel can be shortened by performing an exhaust process and a heating process in a chamber at a room temperature.

According to an embodiment of the present disclosure, by performing induction heating of the sealing cap using a heating coil, local heating of the sealing material is achieved through the sealing cap without high temperature heat being transmitted to the glass, thereby preventing breakage of the glass.

According to an embodiment of the present disclosure, the sealing cap and the sealing material can be easily joined by seating the sealing cap on the sealing material using a cylinder and heating the sealing material through the induction-heated sealing cap.

According to an embodiment of the present disclosure, the sealing cap and the sealing material can be firmly coupled by pressing the sealing cap using a cylinder.

According to an embodiment of the present disclosure, by providing a seating guide to the sealing cap, the sealing cap can be positioned in place at the joining position of the sealing material.

DETAILED DESCRIPTION OF THE EMBODIMENTS

Figure 1:
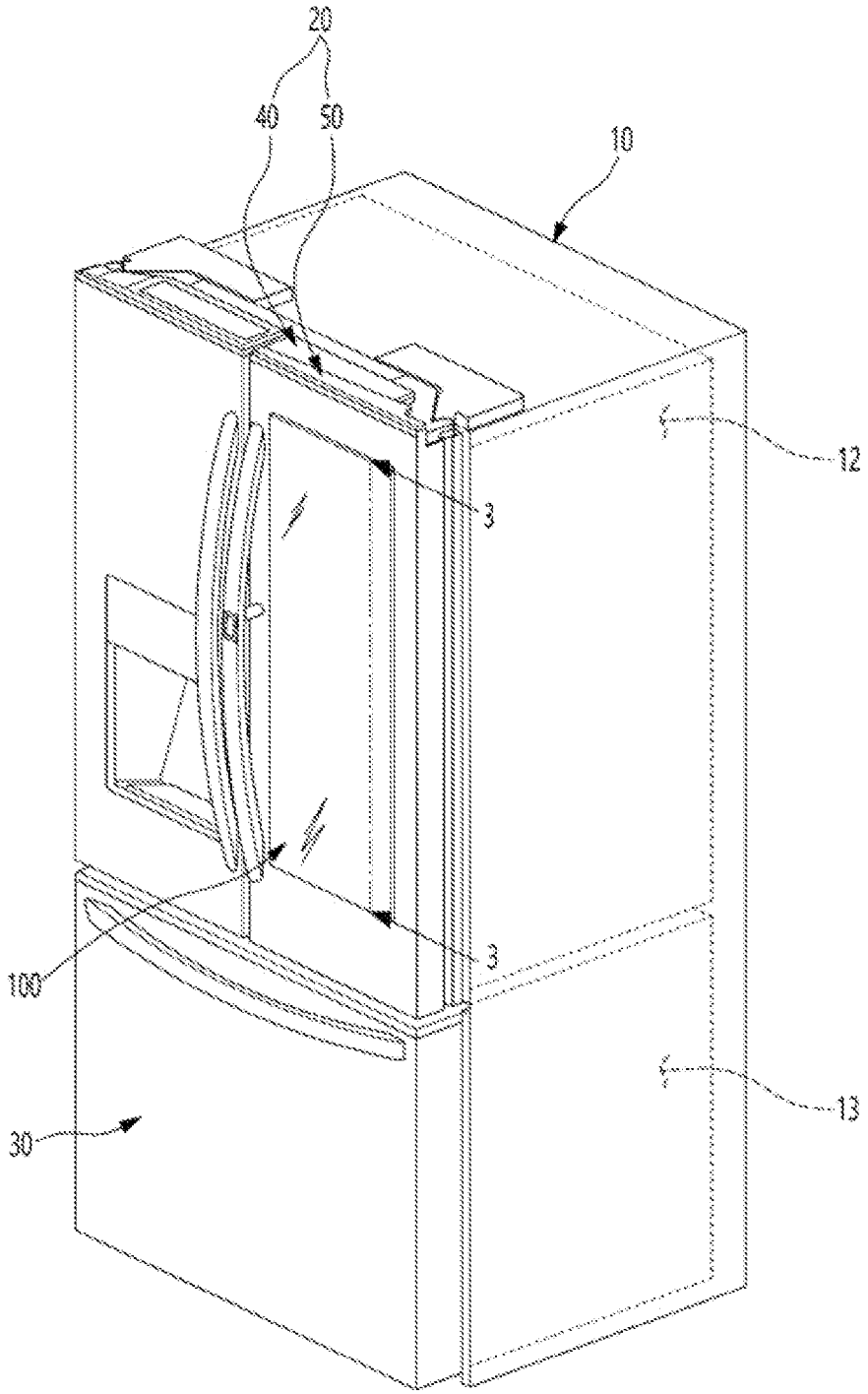
FIG. 1 is a perspective view illustrating a refrigerator provided with a vacuum insulation panel according to a first embodiment of the present disclosure.

Hereinafter, some embodiments of the present disclosure will be described in detail through illustrative drawings. When adding reference numerals to components in each drawing, it should be noted that identical components are given the same reference numerals as much as possible even if they are illustrated in different drawings. Additionally, when describing embodiments of the present disclosure, if detailed descriptions of related known configurations or functions are judged to impede understanding of the embodiments of the present disclosure, the detailed descriptions will be omitted.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

FIG. 1 is a perspective view illustrating a refrigerator provided with a vacuum insulation panel according to a first embodiment of the present disclosure.

Referring to FIG. 1, the vacuum insulation panel 100 according to the first embodiment of the present disclosure can be installed in home appliances. For example, the home appliance may include a refrigerator or cooking appliance.

The vacuum insulation panel 100 can be installed on the door of a home appliance. Below, a vacuum insulation panel provided on the door of a refrigerator will be described as an example of a home appliance. However, the type of home appliance is not limited to refrigerators and can be applied to other home appliances as well.

The refrigerator 1 according to an embodiment of the present disclosure may include a cabinet 10 forming a storage space and a door 20 opening and closing the storage space.

The interior of the cabinet 10 may be divided into upper and lower sections by a barrier, and a refrigerating chamber 12 may be formed at an upper portion of the cabinet 10 and a freezing chamber 13 may be formed at a lower portion of the cabinet 10.

The door may include a refrigerating chamber door 20 and a freezing chamber door 30.

The refrigerating chamber door 20 can open and close the opened front surface of the refrigerating chamber 12. For example, the refrigerating chamber door 20 may be rotatably provided in front of the refrigerating chamber 12.

The refrigerating chamber door 20 may be provided with a left and right pair so that the refrigerating chamber 12 is shielded by the pair of doors. Additionally, the freezing chamber door 30 can be withdrawn in a drawer-type, and can be configured to open and close the freezing chamber 13 by introducing and withdrawing the freezing chamber door.

The freezing chamber door 30 can open and close the opened front surface of the freezing chamber 13. For example, the freezing chamber door 30 is configured as a drawer-type door and may be slidably withdrawn to the front of the freezing chamber 13.

The interior of the refrigerating chamber 12 and the freezing compartment 13 may be provided with various storage members such as shelves, drawers, or baskets. If necessary, the storage member may be introduced and withdrawn in a state where the refrigerating chamber door 20 and the freezing chamber door 30 open, and food can be stored by introduction and withdrawal thereof.

The refrigerating chamber door 20 and the freezing chamber door 30 form an entire outer appearance when viewed from the front and are made of a metal material, so that the entire refrigerator 1 can have a metal texture.

Meanwhile, among the pair of refrigerating chamber doors 20, the refrigerating chamber door 20 on the right side (as seen in FIG. 1) may be configured to be dually opened and closed. In detail, the refrigerating chamber door 20 located on the right side may include a main door 40 for opening and closing the refrigerating chamber 12 and a sub door 50 rotatably disposed on the main door 40 to open and close the opening formed in the main door 40.

The main door 40 may be formed to have the same size as the refrigerating chamber door 20 on the left side (as seen in FIG. 1) among a pair of refrigerating chamber doors 20 and is rotatably mounted to the cabinet 10 by an upper hinge and a lower hinge to open and close at least a portion of the refrigerating chamber 12.

A storage space may be formed on the rear surface of the main door 40. For example, the storage space may include a door basket.

When the sub door 50 is opened, the opening of the main door 40 is opened, and access to the rear storage space (for example, door basket) of the main door 40 may be possible through the opening of the main door 40.

The sub door 50 may include a vacuum insulation panel 100. The vacuum insulation panel 100 may include a transparent material such as glass. Therefore, even when the sub door 50 is closed, it is possible to see through the inside of the storage space behind the sub door 50, for example, the door basket or the inside of the refrigerating chamber 12. Due to the vacuum insulation panel 100, the sub door 50 may be called a see-through door.

The vacuum insulation panel 100 is configured so that light transmittance and reflectance can be adjusted. Therefore, it can be configured to selectively change the transparent or opaque state according to the user's manipulation. Therefore, it becomes transparent only in the state desired by the user to make the interior of the refrigerator visible, and in other states it can remain opaque.

Figure 2:
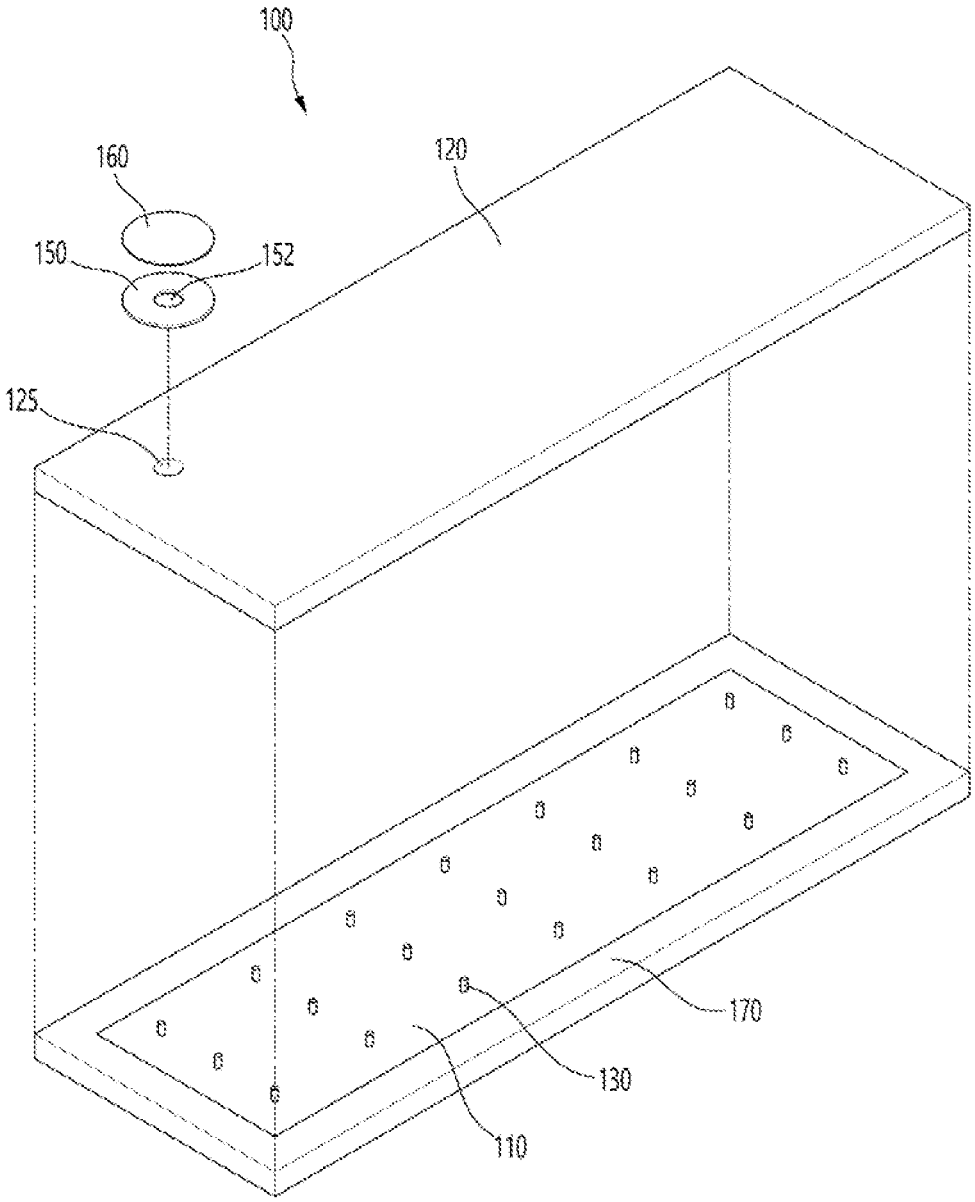
FIG. 2 is an exploded perspective view illustrating the configuration of the vacuum insulation panel according to the first embodiment of the present disclosure.
Figure 3:
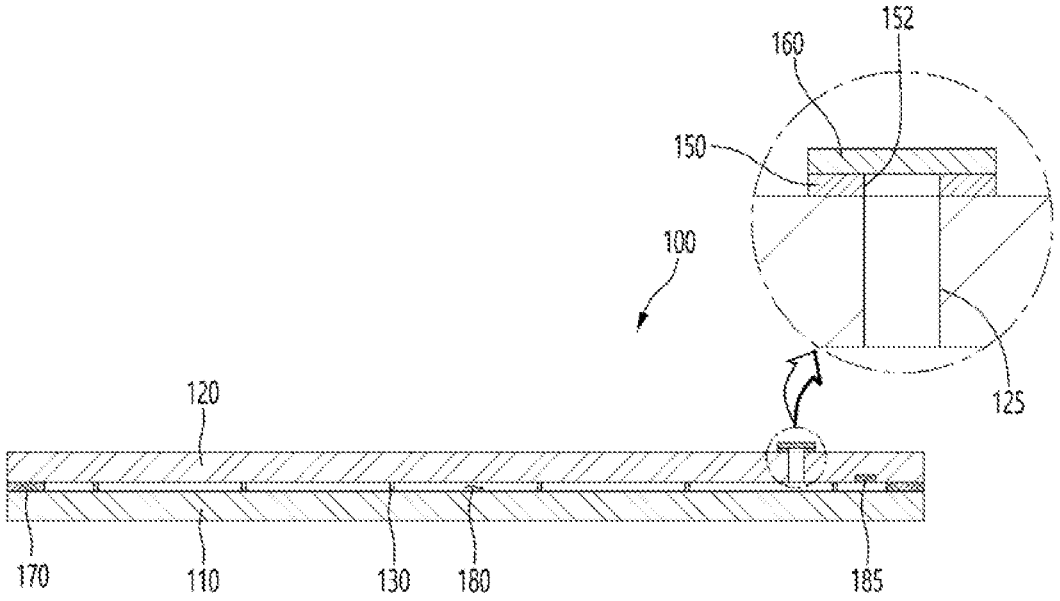
FIG. 3 is a cross-sectional view taken along line 3-3 in FIG. 1 and illustrating the configuration of a vacuum insulation panel.

FIG. 2 is an exploded perspective view illustrating the configuration of the vacuum insulation panel according to the first embodiment of the present disclosure, and FIG. 3 is a cross-sectional view taken along line 3-3 in FIG. 1 and illustrating the configuration of a vacuum insulation panel.

Referring to FIGS. 2 and 3, the vacuum insulation panel 100 according to the first embodiment of the present disclosure may include a plurality of panels 110 and 120. The plurality of panels 110 and 120 may include a first panel 110 and a second panel 120 forming a vacuum space therein.

The second panel 120 may be coupled to one side of the first panel 110.

The first panel 110 and the second panel 120 may be made of a transparent material. For example, the first panel 110 and the second panel 120 may be made of transparent glass or transparent ceramic.

The first panel 110 and the second panel 120 are provided in the form of a thin plate. For example, the first and second panels 110 and 120 may have the shape of a quadrangular panel. Additionally, the first and second panels 110 and 120 may be provided to have the same size and shape.

For convenience of explanation, the first panel 110 may be referred to as "first pane glass" and the second panel 120 may be referred to as "second pane glass."

The first and second panels 110 and 120 may be configured to be bonded to each other. A sealant 170 may be provided between the first and second panels 110 and 120. In detail, the sealant 170 is provided on the edge of the first panel 110 and the second panel 120, and can perform the function of sealing the space between the first and second panels 110 and 120.

The sealant 170 may be applied to the first panel 110. For example, the sealant 170 may be sprayed on the first plate glass 110. Additionally, the sealant 170 may be made of glass frit or ceramic material.

When the first and second panels 110 and 120 are assembled to form a panel assembly and heated, the sealant 170 may be melted and compressed between the first and second panels 110 and 120.

The first and second panels 110 and 120 are disposed to be spaced apart from each other in the vertical direction, and a vacuum layer 180 as a vacuum space may be formed in the spaced apart space. In other words, the vacuum layer 180 may be formed between one surface of the first panel 110 (upper surface based on FIG. 3) and one surface of the second panel 120 (lower surface based on FIG. 3). The vacuum pressure of the vacuum layer 180 may be in the range of $1*10^{-1}$ to $10^{-5}$ Torr.

A spacer 130 may be provided between the first and second panels 110 and 120 to support the first and second panels 110 and 120. The spacer 130 is provided in the vacuum layer 180 and, for example, may have a substantially cylindrical shape. The spacer 130 may be made of ceramic material.

The lower portion of the spacer 130 may be supported on the upper surface of the first panel 110 based on FIG. 3, and the upper portion may support the lower surface of the second panel 120.

The spacer 130 includes a plurality of spacers 130. The plurality of spacers 130 may be spaced apart from each other and disposed within the vacuum layer 180.

The second panel 120 is provided with a sealing cap 160. The sealing cap 160 is a component that seals the exhaust hole 125 formed in the second panel 120 and can be understood as a thin plate cap.

The exhaust hole 125 may be formed in the first panel 110 rather than the second panel 120.

The sealing cap 160 is inductively heated by the heating coil 220 (see FIG. 4), and may be made of a metal material for induction heating. For example, the metal material may include a stainless steel material.

The exhaust hole 125 is configured to exhaust gas existing between the first and second panels 110 and 120 in order to form a vacuum layer 180 in the space between the first and second panels 110 and 120, and may be configured to penetrate the second panes 110 and 120 vertically. In other words, the exhaust hole 125 may be formed to penetrate from the upper surface to the lower surface of the second panel 120.

The sealing cap 160 may be attached to the second panel 120 using a sealing material 150. The sealing material 150 is melted by receiving heat from the sealing cap 160, and during the cooling process, the sealing cap 160 can be attached to the second panel 120.

The sealing material 150 may be made of glass frit or ceramic material.

The sealing material 150 may be seated on the second panel 120.

The sealing material 150 may be composed of an O-ring. The sealing material 150 may form a through-hole 152 communicating with the exhaust hole 125 of the second panel 120. In the exhaust process for forming the vacuum layer of the first and second panels 110 and 120, the gas in the panel assembly 110 and 120 can be discharged to the outside through the exhaust hole 125 of the second panel 120 and the through-hole 152 of the sealing material 150.

The sealing cap 160 may be seated on the sealing material 150. The sealing material 150 may be disposed between the sealing cap 160 and the second panel 120.

Figure 5:
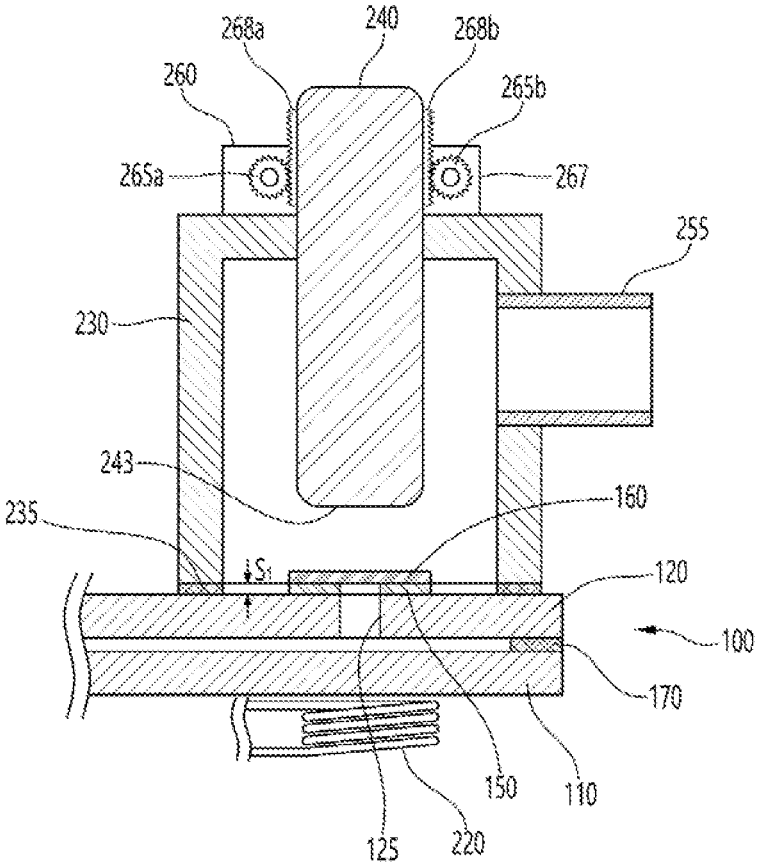
FIG. 5 is a cross-sectional view illustrating a state where a vacuum chamber according to the first embodiment of the present disclosure is installed in a panel assembly.

Accordingly, the sealing cap 160 may be spaced apart from the second panel 120 by the first distance S1 and may not be in contact with the second panel 120 (see FIG. 5). When the sealing cap 160 is inductively heated, direct transfer of high temperature heat of the sealing cap 160 to the first and second panels 110 and 120 may be limited. Ultimately, the first and second panels 110 and 120 may not be subjected to thermal shock due to high temperature heat.

The panel assembly 110, 120 may further include a gas adsorbent 185 (getter). The gas adsorbent 185 may be understood as a component capable of adsorbing moisture or gas that may be generated during the manufacturing process of the vacuum insulation panel 100. For example, the gas adsorbent 185 may be provided in the first panel 110 or the second panel 120.

In other words, even if the vacuum layer 180 is formed inside the panel assembly 110 and 120, moisture or a certain gas may be generated in the first and second panels 110 and 120 or the spacer 130, and the gas adsorbent 185 adsorbs these gases and ensures that a vacuum state is maintained. For example, the gas adsorbent 185 may include a non-evaporable getter that is activated when an electric current flows. After manufacturing of the panel assembly 110, 120 is completed, power supplied from the outside of the panel assembly 110, 120 may be supplied to the gas adsorbent 185 through a wire.

Figure 4:
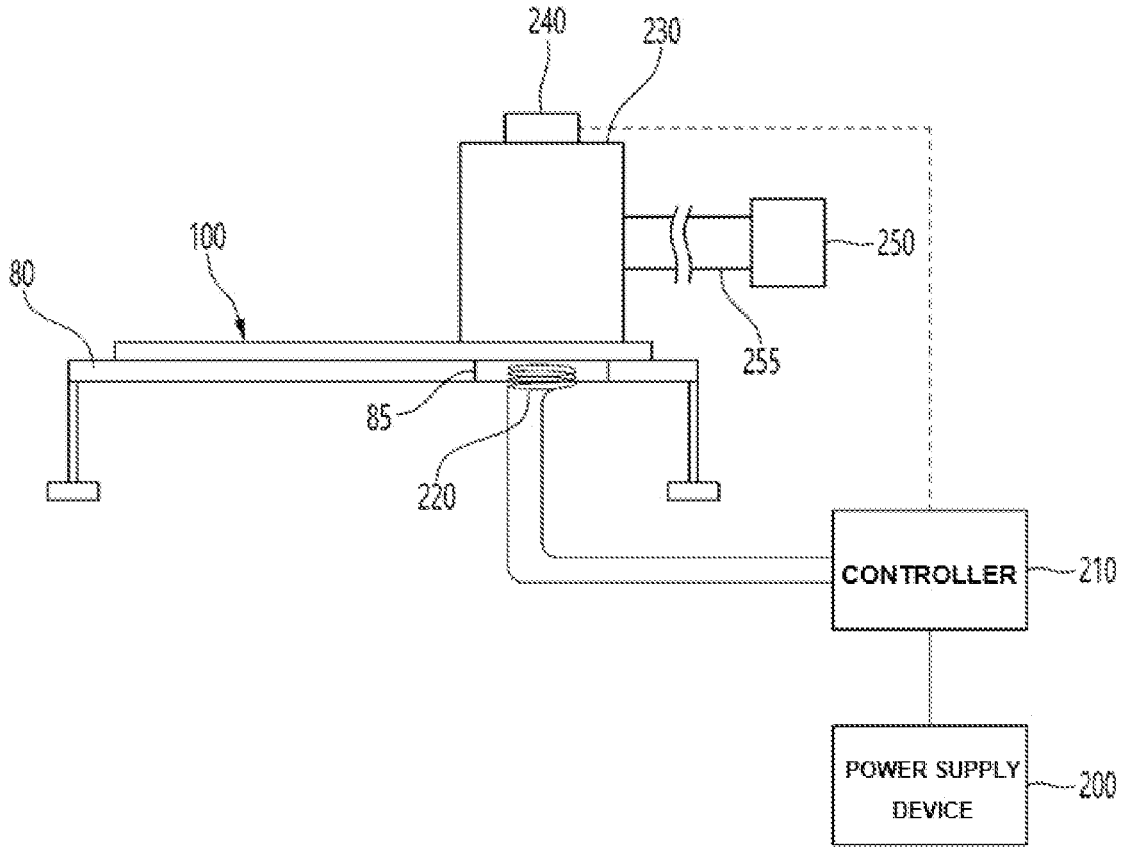
FIG. 4 is a schematic diagram illustrating an apparatus for manufacturing a vacuum insulation panel according to the first embodiment of the present disclosure.

FIG. 4 is a schematic diagram illustrating an apparatus for manufacturing a vacuum insulation panel according to the first embodiment of the present disclosure, and FIG. 5 is a cross-sectional view illustrating a state where a vacuum chamber according to the first embodiment of the present disclosure is installed in a panel assembly.

Referring to FIGS. 4 and 5, the apparatus for manufacturing a vacuum insulation panel according to the first embodiment of the present disclosure may include a chamber housing 230 having a space in communication with the vacuum layer 180 of the panel assembly 110, 120 in order to perform the exhaust process and heating process of the panel assembly 110, 120.

The chamber housing 230 may be made of glass frit or ceramic material, for example.

The apparatus for manufacturing a vacuum insulation panel may further include an exhaust pipe 255 coupled to the chamber housing 230. The exhaust pipe 255 extends to the outside of the chamber housing 230 and may be connected to an exhaust pump 250. When the exhaust pump 250 is driven, an exhaust process to create a vacuum inside the panel assembly 110, 120 may be performed.

The chamber housing 230 may be installed in the panel assembly 110, 120. The chamber housing 230 may be placed in a position to cover the exhaust hole 125 of the panel assembly 110, 120.

The chamber housing 230 may be seated on the second panel 120. A chamber sealing member 235 may be installed on the lower surface of the chamber housing 230 to seal the internal space of the chamber housing 230. The chamber sealing member 235 may be disposed to be in contact with the second panel 120.

By the chamber sealing member 235, the internal space defined by the chamber housing 230 and the panel assembly 110, 120 may be sealed except for the portion where the exhaust pipe 255 is connected. Accordingly, when the exhaust process is performed, the gas discharged from the panel assembly 110, 120 may be discharged to the outside of the chamber housing 230 through the exhaust pipe 255.

The panel assembly 110, 120 are placed on a workbench 80, and a chamber housing 230 may be installed on the panel assembly 110, 120. The chamber housing 230 may be placed on the second panel 120 where the exhaust hole 125 is formed.

A hole 85 in which the heating coil 220 is located may be formed in the workbench 80. The hole 85 is formed by a portion of the workbench 80 penetrating upward and downward, and the heating coil 220 may be located adjacent to the panel assembly 110, 120 on the lower side of the panel assembly 110, 120.

For example, the heating coil 220 may be positioned at a distance of several millimeters (mm) from the first panel 110 of the panel assembly 110 and 120.

The heating coil 220 may be understood as a heating device (heater) for inductively heating the sealing cap 160.

The apparatus for manufacturing a vacuum insulation panel may further include a power supply device 200 for supplying power to the heating coil 220. The power supply device 200 can supply voltage and current at a frequency suitable for induction heating.

The apparatus for manufacturing a vacuum insulation panel may further include a controller 210 connected to the power supply device 200. The controller 210 may be located between the power supply device 200 and the heating coil 220.

The controller 210 may be configured to convert the voltage and current supplied to the power supply device 200 into low voltage and high current to supply power to the resonance circuit.

The heating coil 220 is connected to the controller 210 and may be configured to apply a high-frequency large current to generate an alternating magnetic field and heat the object to be heated. The object to be heated may include a sealing cap 160. Therefore, when the heating coil 220 operates, the apparatus for manufacturing a vacuum insulation panel may further include a chiller for supplying cooling water circulating through the power supply device 200, the controller 210, and the heating coil 220 by induction heating.

The apparatus for manufacturing a vacuum insulation panel may further include a cylinder 240 for moving the sealing cap 160. The cylinder 240 may be movably supported on the chamber housing 230.

The cylinder 240 may be configured to extend vertically through the upper end of the chamber housing 230. A portion of the cylinder 240 may be located inside the chamber housing 230, and another portion thereof may protrude upward from the upper end of the chamber housing 230.

The cylinder 240 can move in the vertical direction.

The apparatus for manufacturing a vacuum insulation panel may further include a driving mechanism for moving the cylinder 240. The driving mechanism may include a motor 260, pinions 265*a* and 265*b* rotating by the driving force of the motor 260, and racks 268*a* and 268*b* interlocked with the pinions 265*a* and 265*b*.

The motor 260 is provided on one side of the cylinder 240, and the first pinion 265*a* may be coupled to the shaft of the motor 260. The motor 260 and the first pinion 265*a* may be supported on the upper end of the chamber housing 230 adjacent to one side of the cylinder 240.

The first rack 268*a* may be coupled to one side of the cylinder 240, and the second rack 268*b* may be coupled to the other side of the cylinder 240.

The first rack 268*a* may be interlocked with the first pinion 265*a*, and the second rack 268*b* may be interlocked with the second pinion 265*b*.

The second pinion 265*b* is rotatably supported on the pinion support part 267, and the pinion support part 267 is adjacent to the other side of the cylinder 240 and may be supported on the upper end of the chamber housing 230.

Additionally, although not illustrated in the drawing, a link member for supporting the cylinder 240 at the upper end of the chamber housing 230 may be further provided. The link member may be understood as a configuration for stably supporting the chamber housing 230 when the cylinder 240 moves in the vertical direction.

For example, the link member may include a two-section link, one end of the two-section link may be coupled to the upper end of the chamber housing 230, and the other end thereof may be coupled to the cylinder 240.

However, the driving mechanism for moving the cylinder 240 is not limited to this, and other driving mechanisms may be used as long as the cylinder 240 can be moved in the vertical direction. For example, the cylinder 240 may be composed of a hydraulic cylinder or a pneumatic cylinder.

The cylinder 240 may include an electromagnet. In other words, when an electric current flows through the cylinder 240, the cylinder becomes magnetized, and when the electric current is cut off, the cylinder can return to its original state of not being magnetized.

When the cylinder 240 is magnetized, a sealing cap 160 may be attached to the cylinder 240. On the other hand, if the cylinder 240 is not magnetized, the sealing cap 160 may be separated from the cylinder 240.

The lower surface 243 of the cylinder 240 may form an attachment surface to which the sealing cap 160 is attached.

The sealing cap 160 may be made of a magnetic material, for example, a ferromagnetic material, so that it can be attached to the cylinder 240 when the cylinder 240 is magnetized.

The cylinder 240 is controlled by the controller 210 and can receive an electric current from the power supply device 200.

While the sealing cap 160 is attached to the cylinder 240, the cylinder 240 may move downward. When the cylinder 240 moves downward to a position where the sealing cap 160 is placed on the sealing material 150, the sealing cap 160 may be separated from the cylinder 240. Then, the cylinder 240 can rise again.

A heating process may be performed while the sealing cap 160 is placed on the sealing material 150.

When the heating process starts, current is applied to the heating coil 220, and an alternating magnetic field is generated, thereby heating the sealing cap 160. The sealing cap 160 is made of a metal material and is suitable for induction heating.

The high-temperature heat generated when the sealing cap 160 is heated can be transferred to the sealing material 150 and melt the sealing material 150, and in the process of cooling the sealing material 150, the sealing cap 160 may be attached to the second panel 120.

Meanwhile, since the sealing cap 160 is not in contact with the second panel 120 by the sealing material 150, it can be limited that the high temperature heat of the sealing cap 160 is directly transmitted to the second panel 120.

On the other hand, other components except the sealing cap 160 may be made of materials that do not undergo induction heating. For example, the first and second panels 110 and 120 may be made of glass frit or ceramic material, and the spacer 130, sealant 170, and sealing material 150 may be made of ceramic materials.

FIGS. 6 to 9 are views illustrating a process in which a sealing cap is attached to a panel assembly through an exhaust process and a heating process of the panel assembly.

Figure 6:
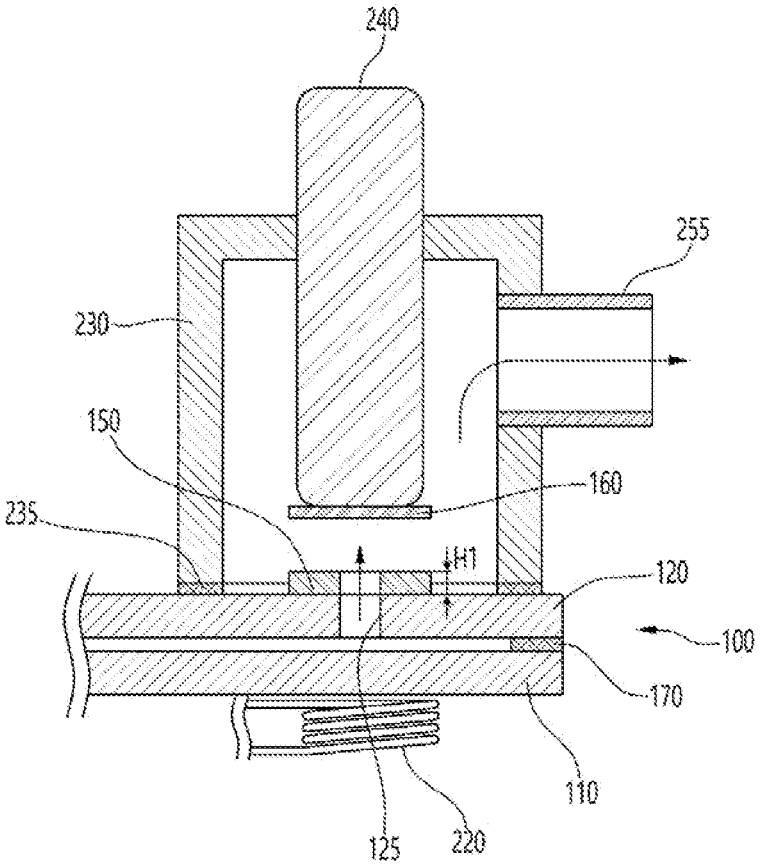
FIGS. 6 to 9 are views illustrating a process in which a sealing cap is attached to a panel assembly through an exhaust process and a heating process of the panel assembly.

First, referring to FIG. 6, after assembling the first and second panels 110 and 120 and melting the sealant 170 to manufacture the panel assembly 110, 120, the chamber housing 230 may be installed to the panel assembly 110, 120 at a room temperature.

A sealing material 150 may be attached to the exhaust hole 125 of the panel assembly 110, 120. Before the sealing material 150 is melted, the height of the sealing material 150 may form a first height H1.

The chamber housing 230 may be installed to shield the exhaust hole 125 and the sealing material 150.

When the chamber housing 230 is installed in the panel assembly 110, 120, the chamber sealing member 235 provided on the lower surface of the chamber housing 230 may be in contact with the panel assembly 110, 120.

The chamber housing 230 is provided with a cylinder 240, and a sealing cap 160 is attached to the lower surface of the cylinder 240 by magnetic force. The sealing cap 160 is spaced upward from the sealing material 150, that is, is not placed on the sealing material 150.

After the chamber housing 230 is installed, an exhaust process may be performed. When the exhaust pump 250 is driven, gas is exhausted from the internal space of the panel assembly 110, 120, and a process of forming a vacuum layer 180 can be performed.

The gas is discharged to the outside of the chamber housing 230 through the internal space of the chamber housing 230 and may flow through the exhaust pipe 255.

Figure 7:
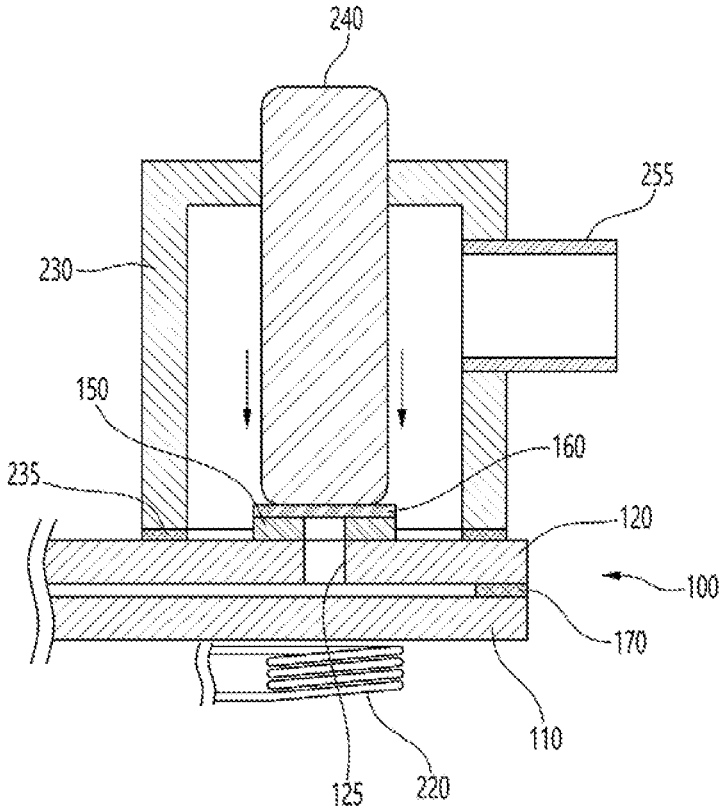

Referring to FIG. 7, the cylinder 240 may move downward after the exhaust process is performed. The cylinder 240 may move downward to a position where the sealing cap 160 is placed on the sealing material 150. When the sealing cap 160 is placed on the sealing material 150, the electric current supply to the cylinder 240 is stopped and the magnetic force is stopped, so that the sealing cap 160 can be separated.

Figure 8:
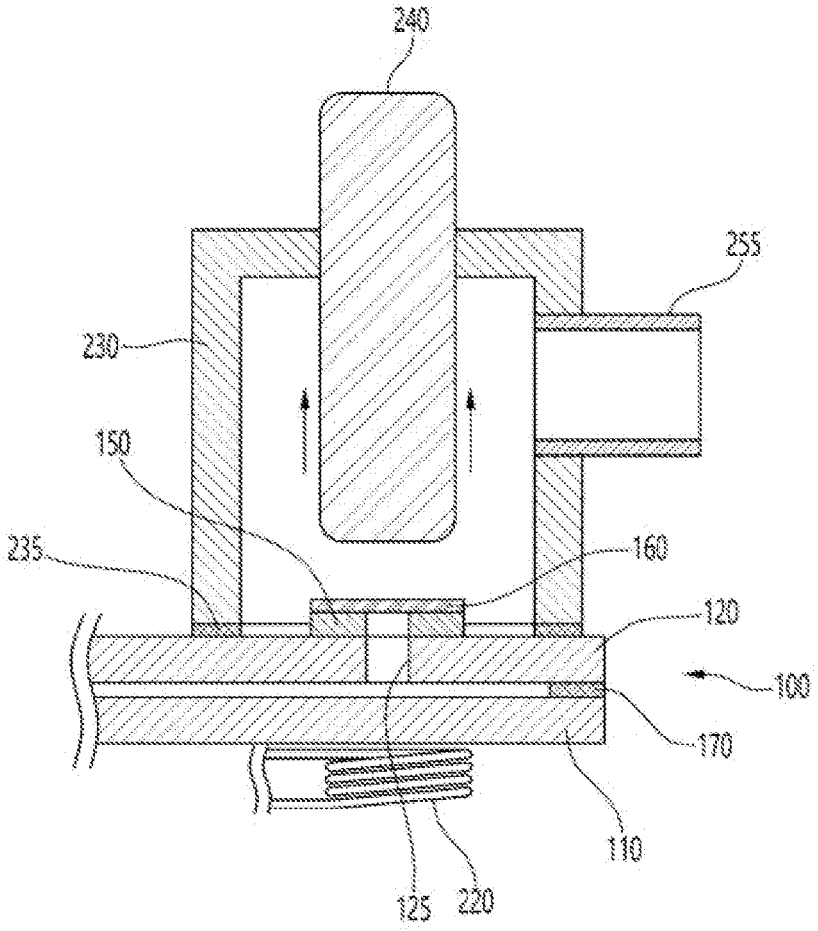

Referring to FIG. 8, when the sealing cap 160 is separated from the cylinder 240, the cylinder 240 may move upward.

A heating process to heat the sealing cap 160 may be performed. Electric current is applied to the heating coil 220 and an alternating magnetic field is generated, so that the sealing cap 160 can be inductively heated.

The sealing cap 160 can be heated to a temperature of about 400 degrees Celsius, and the high temperature heat of the sealing cap 160 can be transferred to the sealing material 150.

In this process, the lower surface of the sealing cap 160 forms a contact surface that is in contact with the sealing material 150, and the contact surface can form a heating surface for heating the sealing material 150. The sealing material 150 may be melted by receiving heat from the heating surface.

Meanwhile, since the panel assembly 110, 120 are not in direct contact with the sealing cap 160 by the sealing material 150, the high temperature heat of the sealing cap 160 may not be directly transmitted to the panel assembly 110, 120. Accordingly, thermal shock can be prevented from occurring in the panel assembly 110, 120.

Figure 9:
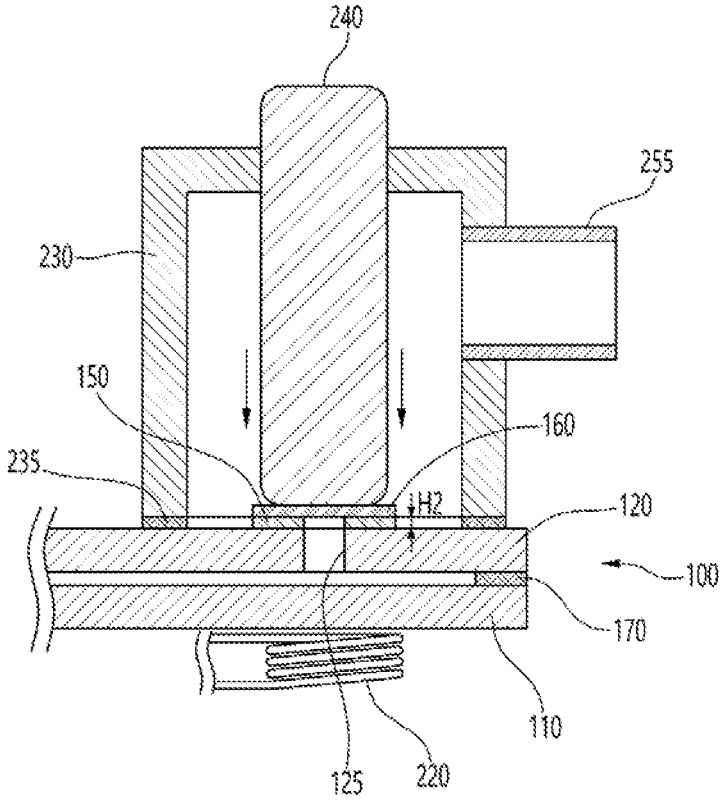

Referring to FIG. 9, the cylinder 240 may pressurize the sealing cap 160 so that the sealing cap 160 can be joined to the sealing material 150 while the sealing material 150 is melted.

To this end, the cylinder 240 may move downward and press the sealing cap 160 downward. The sealing cap 160 is pressed toward the molten sealing material 150 and may be attached to the sealing material 150 while the sealing material 150 is cooling. In other words, the cylinder 240 can function as a press mechanism.

When the sealing cap 160 is attached to the sealing material 150, the height of the sealing material 150 may decrease to form a second height H2. The second height H2 may be smaller than the first height H1 described in FIG. 6.

Figure 10:
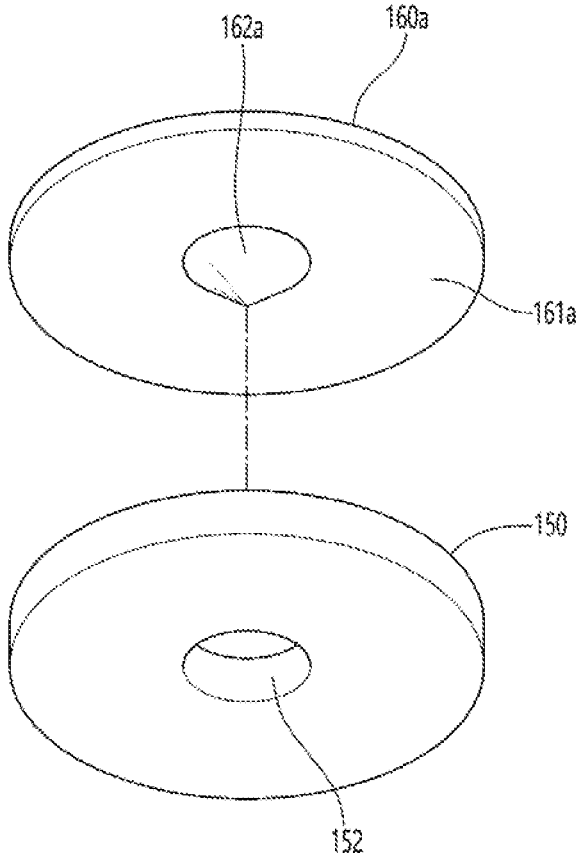
FIG. 10 is an exploded view of a sealing cap and a sealing material illustrating another example of the sealing cap according to the first embodiment of the present disclosure.
Figure 11:
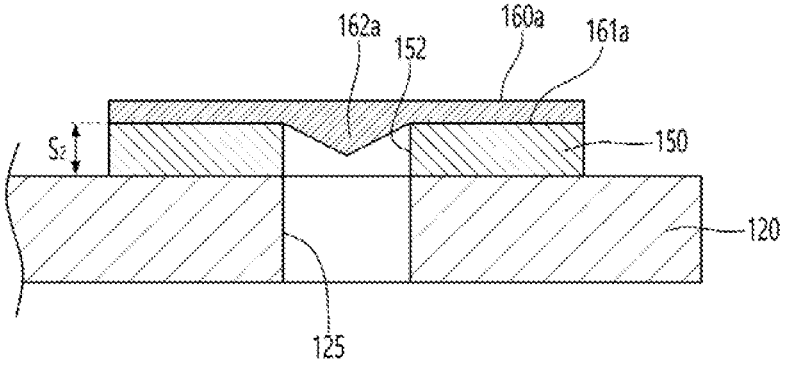
FIG. 11 is a cross-sectional view illustrating a state where the sealing cap of FIG. 10 is seated on a sealing material.

FIG. 10 is an exploded view of a sealing cap and a sealing material illustrating another example of the sealing cap according to the first embodiment of the present disclosure, and FIG. 11 is a cross-sectional view illustrating a state where the sealing cap of FIG. 10 is seated on a sealing material.

Referring to FIGS. 10 and 11, the sealing cap 160*a* according to another example of the present disclosure may include a seating guide 162*a* inserted into the through-hole 152 of the sealing material 150.

In detail, the sealing cap 160*a* may include a substantially disk-shaped cap main body 161*a* and a seating guide 162*a* protruding from the cap main body 161*a*.

The seating guide 162*a* may protrude from approximately the center of the cap main body 161*a* in a direction toward the sealing material 150. The seating guide 162*a* may function to prevent the seating position from being incorrectly formed when the sealing cap 160*a* is placed on the sealing material 150 by the cylinder 240.

In other words, the seating guide 162*a* may guide the sealing cap 160*a* to be seated on the sealing material 150 while the center of the sealing cap 160*a* is concentric with the sealing material 150.

The seating guide 162*a* may be configured to protrude from the sealing cap 160*a* and have a conical shape. The apex and side surface of the cone may be located inside the through-hole 152 of the sealing material 150, and the diameter of the bottom of the cone may be slightly smaller than the diameter of the through-hole 152.

The cap main body 161*a* is in contact with the sealing material 150, and the contact surface may form a heating surface that transfers heat of the sealing cap 160*a* to the sealing material 150. Additionally, the side surface of the cone may also form a heating surface for heating the sealing material 150.

On the other hand, so that the sealing cap 160*a* is not in contact with the panel assembly 110, 120, the cap main body 161*a* may be spaced apart from the second panel 120 by a predetermined distance S2.

Due to this configuration of the sealing cap 160*a*, the sealing cap 160*a* may be seated in the correct position of the sealing material 150.

Figure 12:
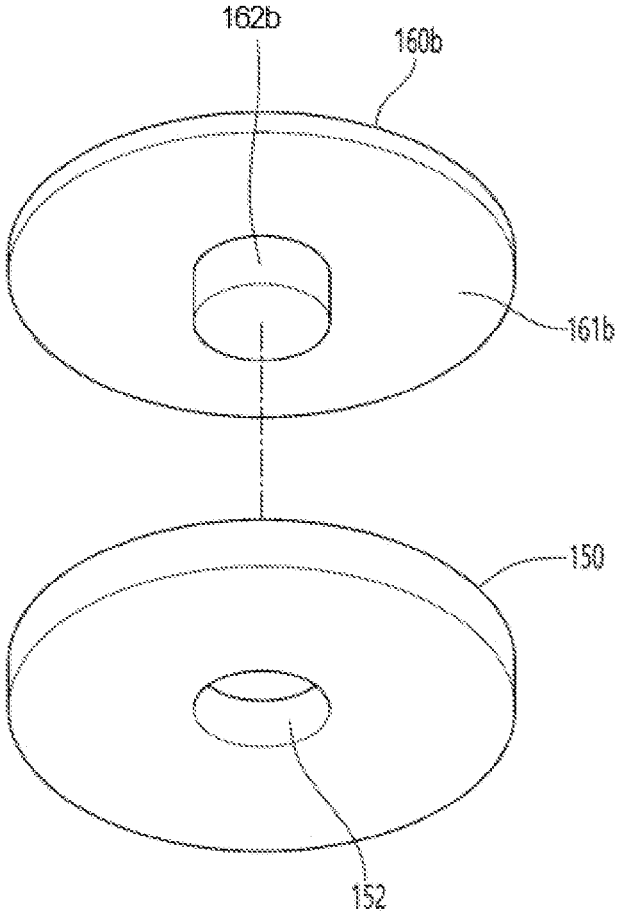
FIG. 12 is an exploded view of a sealing cap and a sealing material illustrating another example of a sealing cap according to the first embodiment of the present disclosure.
Figure 13:
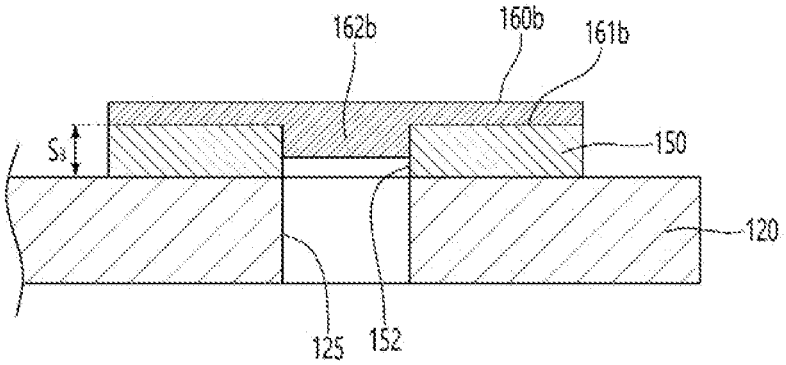
FIG. 13 is a cross-sectional view illustrating a state where the sealing cap of FIG. 12 is seated on a sealing material.

FIG. 12 is an exploded view of a sealing cap and a sealing material illustrating another example of a sealing cap according to the first embodiment of the present disclosure, and FIG. 13 is a cross-sectional view illustrating a state where the sealing cap of FIG. 12 is seated on a sealing material.

Referring to FIGS. 12 and 13, the sealing cap 160*b* according to another example of the present disclosure may include a seating guide 162*b* inserted into the through-hole 152 of the sealing material 150.

In detail, the sealing cap 160*b* may include a substantially disk-shaped cap main body 161*b* and a seating guide 162*b* protruding from the cap main body 161*b*.

The seating guide 162*b* may protrude from approximately the center of the cap main body 161*b* in a direction toward the sealing material 150. The seating guide 162*b* may function to prevent the seating position from being incorrectly formed when the sealing cap 160*b* is placed on the sealing material 150 by the cylinder 240.

In other words, the seating guide 162*b* may guide the sealing cap 160*b* to be seated on the sealing material 150 while the center of the sealing cap 160*b* is concentric with the sealing material 150.

The seating guide 162*a* may be configured to protrude from the sealing cap 160*a* and have a cylindrical shape. The side surface of the cylindrical shape may be located inside the through-hole 152 of the sealing material 150, and the diameter of the bottom of the cylinder may be slightly smaller than the diameter of the through-hole 152.

The cap main body 161*b* is in contact with the sealing material 150, and the contact surface may form a heating surface that transfers heat of the sealing cap 160*b* to the sealing material 150.

On the other hand, so that the sealing cap 160*b* is not in contact with the panel assembly 110, 120, the cap main body 161*b* may be spaced apart from the second panel 120 by a predetermined distance S3.

Due to this configuration of the sealing cap 160*b*, the sealing cap 160*b* can be seated in the correct position of the sealing material 150.

Figure 14:
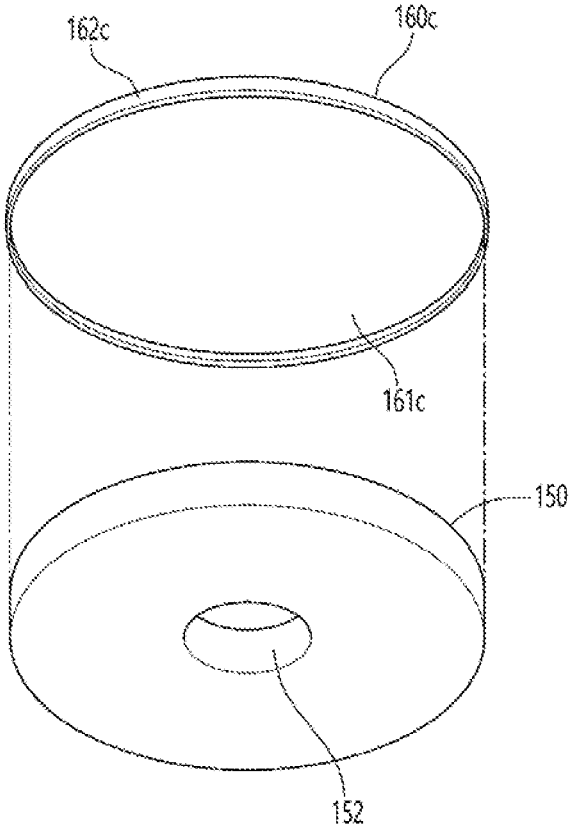
FIG. 14 is an exploded view of a sealing cap and a sealing material illustrating another example of the sealing cap according to the first embodiment of the present disclosure.
Figure 15:
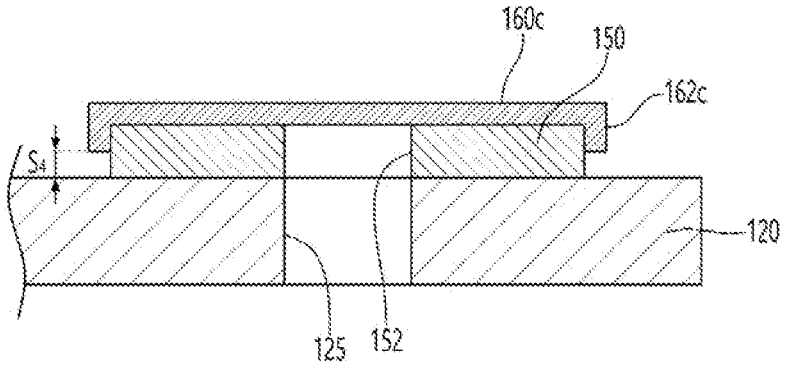
FIG. 15 is a cross-sectional view illustrating a state where the sealing cap of FIG. 14 is seated on a sealing material.

FIG. 14 is an exploded view of a sealing cap and a sealing material illustrating another example of the sealing cap according to the first embodiment of the present disclosure, and FIG. 15 is a cross-sectional view illustrating a state where the sealing cap of FIG. 14 seated on a sealing material.

Referring to FIGS. 14 and 15, the sealing cap 160*c* according to another example of the present disclosure may include a seating guide 162*c* surrounding the outer peripheral surface of the sealing material 150.

In detail, the sealing cap 160*c* may include a substantially disk-shaped cap main body 161*c* and a seating guide 162*c* protruding from the edge of the cap main body 161*c*. The seating guide 162*c* may have a substantially ring shape.

Due to the cap main body 161*c* and the seating guide 162*c*, the sealing cap 160*c* may have a cap shape.

The seating guide 162*c* may function to prevent the seating position from being incorrectly formed when the sealing cap 160*c* is placed on the sealing material 150 by the cylinder 240. In other words, the seating guide 162*c* may guide the sealing cap 160*c* to be seated on the sealing material 150 while the center of the sealing cap 160*b* is concentric with the sealing material 150.

The seating guide 162*c* may be disposed to surround a portion of the outer peripheral surface of the sealing material 150. In other words, a portion of the sealing material 150 may be accommodated in the space defined by the cap main body 161*c* and the seating guide 162*c*.

At this time, the lower end portion of the seating guide 162*c* may be spaced apart from the second panel 120 by a predetermined distance S4 so that the sealing cap 160*c* is not in contact with the panel assembly 110, 120.

The cap main body 161*c* is in contact with the sealing material 150, and the contact surface may form a heating surface that transfers heat of the sealing cap 160*c* to the sealing material 150.

The seating guide 162*c* is located in contact with or adjacent to the outer peripheral surface of the sealing material 150, and the seating guide 162*c* may form a heating surface that transfers heat to the sealing material 150.

Due to this configuration of the sealing cap 160*c*, the sealing cap 160*c* can be seated in the correct position of the sealing material 150.

Below, other embodiments of the present disclosure will be described. Since these embodiments differ only in some configurations compared to the first embodiment, the description will focus on the differences, and the description and reference numerals of the first embodiment will be used for portions that are the same as the first embodiment.

Figure 16:
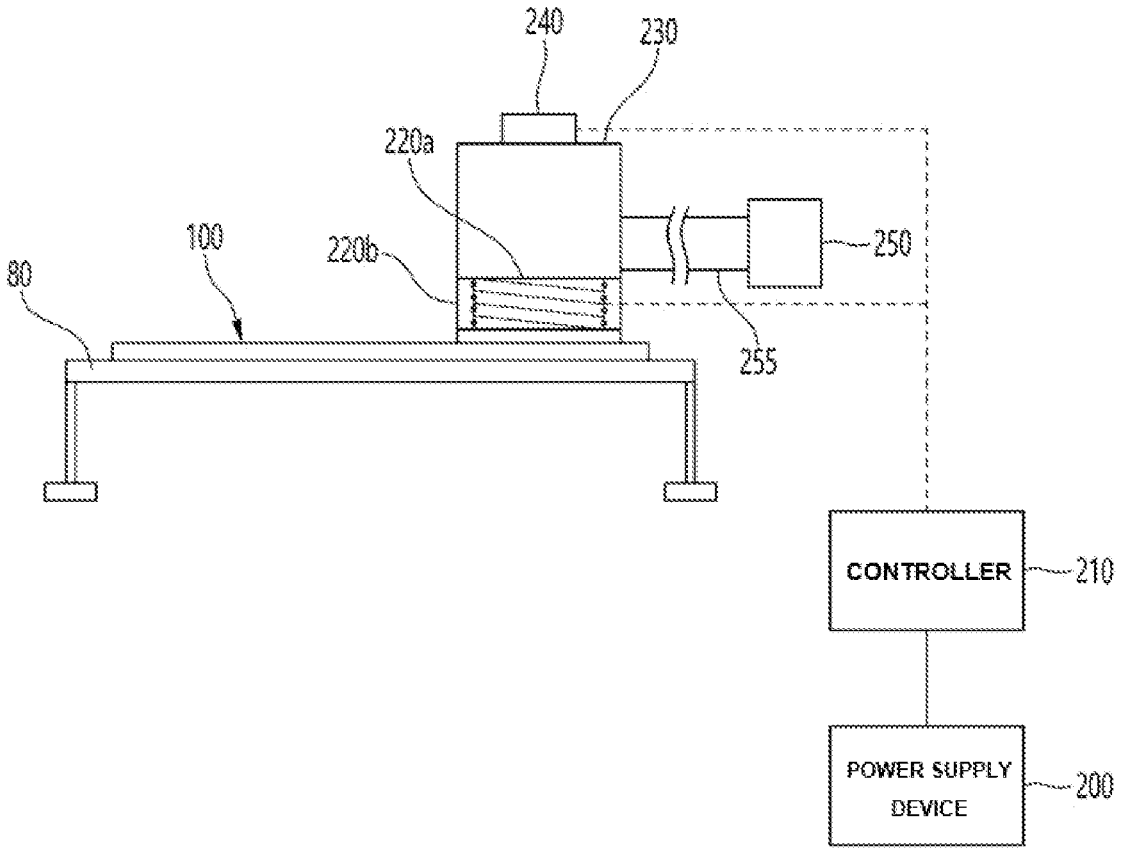
FIG. 16 is a schematic diagram illustrating an apparatus for manufacturing a vacuum insulation panel according to a second embodiment of the present disclosure.
Figure 17:
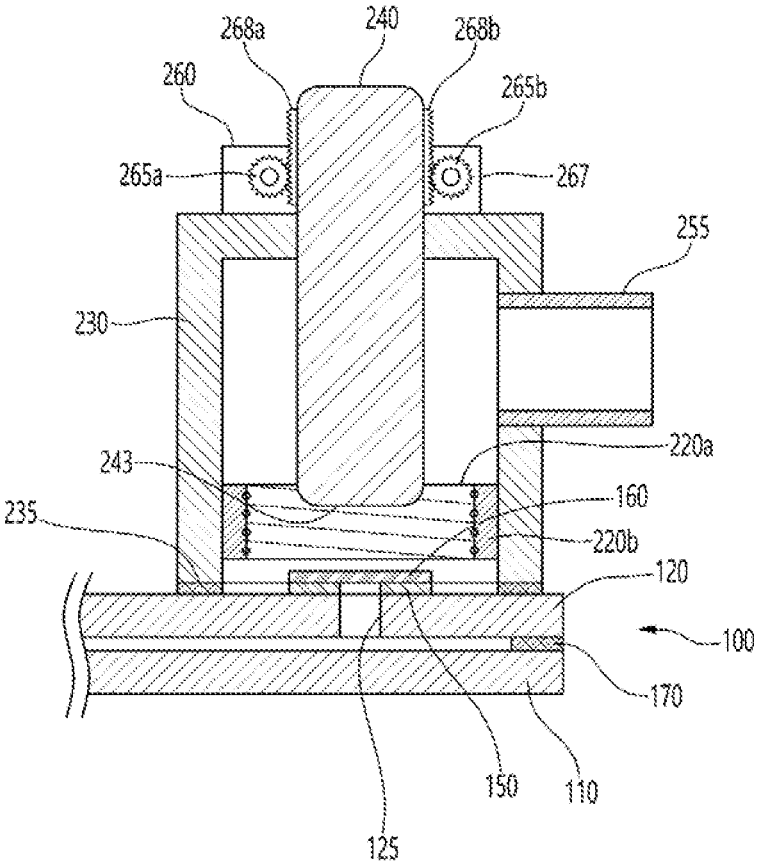
FIG. 17 is a cross-sectional view illustrating a state where the vacuum chamber is installed in the panel assembly according to the second embodiment of the present disclosure.

FIG. 16 is a schematic diagram illustrating an apparatus for manufacturing a vacuum insulation panel according to a second embodiment of the present disclosure, and FIG. 17 is a cross-sectional view illustrating a state where the vacuum chamber is installed in the panel assembly according to the second embodiment of the present disclosure.

Referring to FIGS. 16 and 17, the apparatus for manufacturing a vacuum insulation panel according to the second embodiment of the present disclosure may include a chamber housing 230 having a space in communication with a vacuum layer 180 of the panel assembly 110, 120.

Instead of the heating coil 220 described in the first embodiment, the apparatus for manufacturing a vacuum insulation panel according to the present embodiment may include a heating coil 220*a* installed inside the chamber housing 230. The heating coil 220*a* receives power from the power supply device 200 and can be controlled by the controller 210.

The heating coil 220*a* is supported on the heater support part 220*b* and may be located in the lower portion of the chamber housing 230 adjacent to the second panel 120. The heater support part 220*b* includes a bracket, and the bracket may be fixed to the inner surface of the chamber housing 230.

The heating coil 220*a* constitutes a coil-shaped heater, and the cylinder 240 can move in the vertical direction through the coil-shaped internal space.

When the heating coil 220*a* operates, the heat generated by the heating coil 220*a* may be transferred to the sealing material 150 to melt the sealing material 150.

As described in the first embodiment, the cylinder 240 can press the sealing cap 160 so that the sealing cap 160 can be joined to the sealing material 150 in a melted state.

To this end, the cylinder 240 may move downward and press the sealing cap 160 downward. The sealing cap 160 is pressed toward the molten sealing material 150 and may be attached to the sealing material 150 while the sealing material 150 is cooling.

Figure 18:
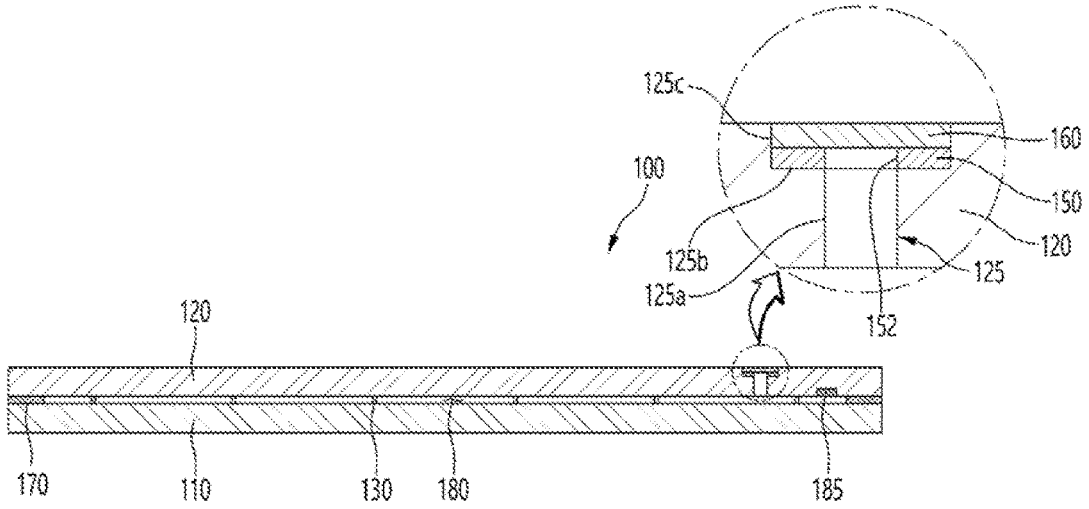
FIG. 18 is a cross-sectional view illustrating the configuration of a vacuum insulation panel according to a third embodiment of the present disclosure.

FIG. 18 is a cross-sectional view illustrating the configuration of a vacuum insulation panel according to a third embodiment of the present disclosure.

Referring to FIG. 18, the vacuum insulation panel 100*a* according to the third embodiment of the present disclosure may include a first panel 110 and a second panel 120 forming a vacuum layer 180 therein.

The second panel 120 may have an exhaust hole 125 for exhausting gas existing between the first and second panels 110 and 120 in order to form a vacuum layer 180 in the space between the first and second panels 110 and 120.

The second panel 120 is provided with a sealing cap 160 to seal the exhaust hole 125.

When the sealing cap 160 is mounted on the second panel 120, the sealing cap 160 may be placed inside the exhaust hole 125 so that the outer surface of the sealing cap 160 is coplanar with respect to the outer surface of the second panel 120.

For example, the sealing cap 160 may be supported or seated on a protrusion formed on the inner peripheral surface of the exhaust hole 125.

The sealing cap 160 may be attached to the second panel 120 using a sealing material 150. The sealing material 150 is melted by receiving heat from the sealing cap 160, and during the cooling process, the sealing cap 160 can be attached to the second panel 120.

The sealing material 150 is seated on the locking protrusion of the exhaust hole 125, and the sealing cap 160 may be placed on the upper side of the sealing material 150.

The exhaust hole 125 may be formed to penetrate the second panel 120. The inner surface of the exhaust hole 125 may include a first inner surface portion 125*a* extending in a direction facing from the inner surface to the outer surface of the second panel 120.

The exhaust hole 125 extends from the first inner surface portion 125*a* and may include a second inner surface portion 125*b* extending in a direction intersecting the extension direction of the first inner surface portion 125*a*. For example, the second inner surface portion 125*b* may extend in a direction approximately perpendicular to the first inner surface portion 125*a*.

The first and second inner surface portions 125*a* and 125*b* extend in directions that intersect each other, so that the exhaust hole 125 may be defined by a protrusion on which the sealing material 150 and the sealing cap 160 are seated.

The exhaust hole 125 extends from the second inner surface portion 125*b* and may include a third inner surface portion 125*c* extending in a direction intersecting the extension direction of the second inner surface portion 125*b*. For example, the third inner surface portion 125*c* may extend in a direction approximately perpendicular to the second inner surface portion 125*b*.

The third inner surface portion 125*c* may extend to meet the outer surface of the second panel 120. The inner diameter of the third inner surface portion 125*c* may be larger than the inner diameter of the first inner surface portion 125*a*.

The height of the third inner surface portion 125*c* may correspond to the sum of the height of the sealing material 150 and the height of the sealing cap 160.

The sealing material 150 and the sealing cap 160 are seated on the second inner surface portion 125*b*, and the sealing cap 160 can be attached to the second panel 120 by the sealing material 150.

According to this configuration, the outer surface of the sealing cap 160 forms the same plane as the outer surface of the second panel 120, so the outer surface of the vacuum insulation panel 100 can form a clean outer surface.

Figure 19:
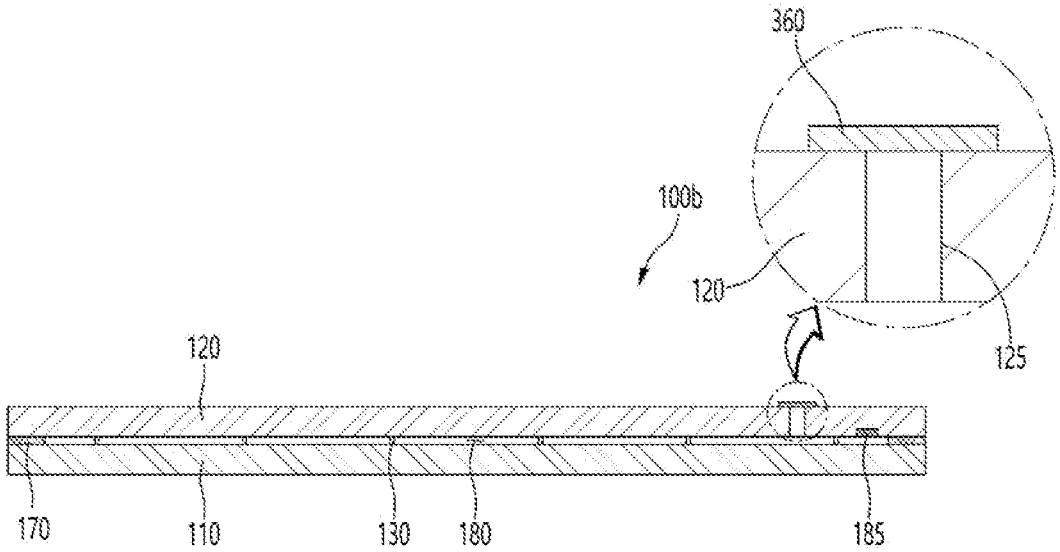
FIG. 19 is a cross-sectional view illustrating the configuration of a vacuum insulation panel according to a fourth embodiment of the present disclosure.

FIG. 19 is a cross-sectional view illustrating the configuration of a vacuum insulation panel according to a fourth embodiment of the present disclosure.

Referring to FIG. 19, the vacuum insulation panel 100*b* according to the fourth embodiment of the present disclosure may include a sealing cap 360 attached to the second panel 120.

The sealing cap 360 may be directly attached (surface contact) to the second panel 120 without using a sealing material.

When the heating coil 220 described in the first embodiment or the heating coil 220*a* described in the second embodiment is operated, the heat generated from the heating coils 220 and 220*a* may melt a portion of the outer surface of the second panel 120.

In a state where a portion of the outer surface of the second panel 120 is melted, the cylinder 240 can press the sealing cap 360 so that the sealing cap 360 can be joined to the second panel 120.

To this end, the cylinder 240 may move downward and press the sealing cap 360 downward. The sealing cap 360 is pressed toward the second panel 120 and may be attached to the sealing material 150 while the second panel 120 is cooled.

According to this configuration, there is an advantage that the exhaust hole can be sealed through a simple structure by attaching the sealing cap to the second panel without a sealing material.

What is claimed is:

1. A method for manufacturing a vacuum insulation panel, the vacuum insulation panel comprising a panel assembly including:

a first panel made of a transparent material and configured to provide a lower surface of the panel assembly;

a second panel made of a transparent material and spaced apart from the first panel, the second panel having an exhaust hole and configured to provide an upper surface of the panel assembly;

a sealant disposed between the first panel and the second panel and configured to maintain a vacuum space;

a sealing material made of a glass frit or ceramic material and attached on the second panel, the sealing material having a through hole communicated with the exhaust hole; and a sealing cap made of a ferromagnetic material and configured to cover the through hole, wherein a manufacturing system for manufacturing the vacuum insulation panel comprises:

a workbench on which the panel assembly is placed;

a chamber housing placed on the second panel;

a cylinder on which the sealing cap is attached;

an induction heating coil disposed below the first panel and facing the sealing cap;

an exhaust pipe connected to an exhaust pump and the chamber housing; and a controller configured to control a power supply device for the induction heating coil and the cylinder, wherein the method for manufacturing the vacuum insulation panel comprises:

attaching the sealing cap to the cylinder by magnetic force generated while the power supply device supplies power to the cylinder;

installing the chamber housing on the panel assembly;

driving the exhaust pump to exhaust gas in the vacuum space through the exhaust hole;

descending the cylinder to cover the through hole;

separating the sealing cap from the cylinder, after the descending the cylinder, by stopping supply of the power to the cylinder to eliminate the magnetic force; and supplying power to the induction heating coil to melt the sealing material after the separating the sealing cap from the cylinder.

2. The method of claim 1, further comprising placing the induction heating coil in a hole of the workbench that supports the panel assembly.

3. The method of claim 1, wherein the installing the chamber housing on the panel assembly comprises:

installing a chamber sealing member on a lower surface of the chamber housing; and disposing the chamber sealing member on the upper surface of the panel assembly.

4. The method of claim 1, further comprising:

connecting the exhaust pipe to the chamber housing before performing the driving of the exhaust pump.

5. The method of claim 1, wherein the sealing material is disposed at the exhaust hole.

6. The method of claim 5, wherein, when the power is supplied to the induction heating coil, the sealing material is melted by heat transferred from the sealing cap and is configured to attach the sealing cap to the second panel.

7. The method of claim 6, wherein, before the supplying power to the induction heating coil, a height of the sealing material on the panel assembly is a first height, and wherein, after attaching the sealing cap to the second panel, the height of the sealing material on the second panel is a second height that is less than the first height.

8. The method of claim 1, wherein the descending the cylinder comprises the controller operating a motor to interlock a pinion gear connected to the motor with a rack gear connected to the cylinder.

9. The method of claim 1, further comprising ascending the cylinder after the separating the sealing cap.

10. The method of claim 9, wherein the supplying power to the induction heating coil is performed after the ascending the cylinder.

11. The method of claim 1, further comprising secondarily descending the cylinder to press the sealing cap such that the sealing cap is joined to the sealing material after the supplying power to the induction heating coil.

12. The method of claim 1, wherein the cylinder comprises an electromagnet configured to be magnetized when the power supply device supplies the power to the cylinder, and wherein the sealing cap is attached to the magnetized electromagnet.

13. The method of claim 1, wherein the sealing cap is separated from the cylinder when the power supply device stops supplying the power to the cylinder and the cylinder is non-magnetized.

* * * * *